US005893660A

United States Patent [19]

Homma et al.

[11] Patent Number: 5,893,660

[45] Date of Patent: Apr. 13, 1999

[54] IMAGE FORMING APPARATUS

[75] Inventors: Toru Homma, Yokohama; Toshifumi Mimura, Kawasaki, both of Japan

[73] Assignee: Kabushiki Kaisha Toshiba, Kawasaki, Japan

[21] Appl. No.: 08/925,135

[22] Filed: Sep. 8, 1997

[30] Foreign Application Priority Data

Sep. 9, 1996 [JP] Japan ..... 8-238110

[51] Int. Cl.[6] ..... G03G 15/02

[52] U.S. Cl. ..... 399/50; 399/53; 399/55

[58] Field of Search ..... 399/38, 50, 43, 399/46, 47, 48, 49, 53, 55, 56

[56] References Cited

U.S. PATENT DOCUMENTS

| | | | |
|---|---|---|---|
| 4,432,634 | 2/1984 | Tabuchi | 399/138 |
| 4,618,246 | 10/1986 | Nagashima et al. | 399/43 |
| 4,734,740 | 3/1988 | Fujii et al. | 399/46 |
| 4,755,850 | 7/1988 | Suzuki et al. | 399/48 |
| 4,974,026 | 11/1990 | Maruyama | 399/46 |
| 5,049,939 | 9/1991 | Koichi | 399/48 |
| 5,206,686 | 4/1993 | Fukui et al. | 399/1 |
| 5,298,943 | 3/1994 | Ide et al. | 399/39 |
| 5,351,107 | 9/1994 | Nakane et al. | 399/49 |

FOREIGN PATENT DOCUMENTS

| | | |
|---|---|---|
| 0 475 334 | 3/1992 | European Pat. Off. . |
| 31 40 853 | 6/1982 | Germany . |
| 38 25 523 | 3/1989 | Germany . |
| 6-83203 | 3/1994 | Japan . |

OTHER PUBLICATIONS

Patent Abstract of Japan, vol. 17, No. 215, (P-1527), Apr. 27, 1993, abstract of Okada Tomoaki, "Developing Device and Method on Electrophotographic Printing", Japanese 4-350864, Dec. 4, 1992.

Patent Abstract of Japan, vol. 16, No. 551, (P-1453), Nov. 20, 1992, abstract of Shinoda Sankichi, "Developing Device", Japanese 4-208957, Jul. 30, 1997.

Patent Abstract of Japan, vol. 17, No. 231, (P-1532), May 11, 1993, abstract of Hasegawa Yoshisuke, "Developing Device", Japanese 4-360172, Dec. 14, 1992.

*Primary Examiner*—Matthew S. Smith
*Assistant Examiner*—Hoan Tran
*Attorney, Agent, or Firm*—Foley & Lardner

[57] ABSTRACT

The present invention provides an image forming apparatus that suffers less toner particles scattering and a narrower variation in image density. In this image forming apparatus, a decrease of a contrast potential difference can be compensated by means of a developing bias voltage generator circuit and a grid bias voltage generator circuit, so that the image density can be kept constant. The apparatus includes a developing mechanism in which the respective average particle diameters of carrier members and toner particles, toner concentration, and the diameter and peripheral speed of a developing roller are optimized. Although the diameter of the developing roller is small, therefore, a high image density can be secured, and the value of toner particles scattering can be lowered.

18 Claims, 8 Drawing Sheets

IMAGE FORMING APPARATUS

BACKGROUND OF THE INVENTION

The present invention relates to an image forming apparatus, in which a latent image is formed on a photosensitive body by using the electrophotographic process and developed by means of toner particles, and the developed image is delivered onto a sheet of paper for use as a transfer medium, and a developing device adapted for use in the image forming apparatus.

In an image forming apparatus that utilizes the electrophotographic process, an electrostatic latent image is formed by giving a predetermined potential to a photosensitive body having photoconductivity, applying light corresponding to image information to the photosensitive body, and selectively attenuating the potential of the photosensitive body, and toner particles are fed to the latent image, whereupon a copy image i.e., printable image of an object of copying is outputted.

The toner particles fed to the photosensitive body i.e., the resulting toner image is transferred to a sheet of paper for use as a transfer medium, and fixed to the sheet of paper by means of a fixing device. Untransferred toner particles remaining on the photosensitive body are removed from its surface by means of a cleaning device.

Many of copying apparatuses use a method in which the toner particles members are frictionally charged to the full by means of carrier members, and the electrostatic latent image formed on the photosensitive body is developed by being fed with the frictionally charged toner particles by means of a developing roller that is located at a fixed distance from the surface of the photosensitive body.

In this case, the quantity of the toner particles attached to the latent image, that is, image density, is maintained by moving (or rotating) the outer peripheral surface i.e., a developing sleeve of the developing roller at a speed higher than the moving speed of the surface of the photosensitive body.

If the developing sleeve of the developing roller is rotated at high speed, however, then the toner particles will be scattered around the photosensitive body or in the copying apparatus.

This scattering is caused by insufficiently charged toner particles, that is, low-charged toner particles. The force of electrostatic attraction between the low-charged toner particles and the carrier members is smaller than that between the normal toner particles and the carrier members. If the developing sleeve of the developing roller is rotated at high speed, therefore, the low-charged toner particles are scattered as it is released from the electrostatic attraction to the carrier members by centrifugal force.

This toner particles scattering can be prevented by two methods, improvement of the developing agent and improvement of the developing device.

According to an example of the method in which the developing agent is improved, the amount of frictional charge on the toner particles are increased to augment the force of electrostatic attraction between the toner particles and the carrier members. Although scattering of the toner particles can be prevented, according to this method, the amount of frictional charge on the toner particles is so large that a high image density cannot be obtained with ease.

According to a proposed example of the method in which the developing device is improved, the ratio of the moving speed of the surface of the developing sleeve of the developing roller to the speed at which the moving speed of the outer peripheral surface of the photosensitive body (hereinafter referred to as processing speed), is reduced. The moving speed of the surface of the developing sleeve can be lowered by increasing the outside diameter of the sleeve. Accordingly, the centrifugal force to which the toner particles on the sleeve is subjected can be reduced by increasing the diameter of the sleeve.

However, the increase of the diameter of the developing sleeve results in an increase in size of the developing device, thereby making the copying apparatus large-sized. Thus, the total cost of the apparatus increases inevitably.

In consideration of these circumstances, there has recently been proposed a developing method that uses small-particle carrier members.

With use of the small-particle carrier members, the specific surface area of a carrier particle compared with the toner particles can be increased. With the ratio in weight between the toner particles and the carrier members is fixed, therefore, the toner concentration can be set at a high value. This indicates that the developing efficiency can be improved. In the case where the target image density is fixed, the increase of the developing efficiency can make the rotating speed of the developing sleeve lower than in the conventional case, thus helping the reduction of the toner particles scattering.

It is ascertained, however, that the small-particle carrier members, especially one with a particle diameter of 50 μm or less, the carrier members adheres to the photosensitive body (so called carrier adhesion) is occurred.

Thus, although the small-particle carrier members can improve the developing efficiency, it is of no practical use on account of its tendency to adhere to the photosensitive body.

BRIEF SUMMARY OF THE INVENTION

An object of the present invention is to provide a developing device, which enjoys a high developing efficiency without carrier members adhesion with use of a small-particle carrier members.

Another object of the invention is to provide a developing device capable of preventing toner particles scattering without increasing the size of its developing roller.

According to the present invention, there is provided an image forming apparatus comprising: charging means for charging an image carrying body; exposure means for forming an electrostatic latent image on the image carrying body charged by the charging means; developing means opposed to the image carrying body and adapted to supply a developing agent to the latent image formed by the exposure means, thereby developing the image; developing bias voltage applying means for applying a developing bias voltage to the developing means; and voltage control means for controlling voltages applied by the charging means and the voltage applying means so that a value obtained by dividing the difference between the developing bias voltage and the potential of the image carrying body exposed by the exposure means by the distance between the image carrying body and the developing means is within a given range.

According to the invention, moreover, there is provided an image forming apparatus comprising: charging means for charging an image carrying body; exposure means for forming an electrostatic latent image on the image carrying body charged by the charging means; developing means opposed to the image carrying body and adapted to supply a developing agent to the latent image formed by the exposure means, thereby developing the image; developing bias voltage applying means for applying a developing bias voltage to the developing means; counting means for counting the frequency in use of the image carrying body and/or the developing agent; and voltage control means for controlling an amount of charge by the charging means and the developing bias voltage in accordance with the frequency counted by the counting means so that a value obtained by dividing the difference between the developing bias voltage and the potential of the image carrying body exposed by the exposure means by the distance between the image carrying body and the developing means is within a given range.

According to the invention, furthermore, there is provided an image forming apparatus comprising: charging means for charging an image carrying body; exposure means for forming an electrostatic latent image on the image carrying body charged by the charging means; a developing roller located at a distance from the image carrying body and storing a developing agent formed of carrier members having a particle diameter of 30 to 50 μm and toner particles mixed in the carrier members so that the covering rate of the carrier members ranges from 30 to 40%, the stored developing agent being used to develop the electrostatic latent image formed by the exposure means; and bias voltage applying means for applying a developing bias voltage to the developing roller so that a value obtained by dividing the difference between the developing bias voltage and the potential of the image carrying body exposed by the exposure means by the distance between the image carrying body and the developing means ranges from 60 to 220 (V/mm), wherein the diameter of the developing roller ranges from 2 $(KV)^2$/12,000 to 2 $(KV)^2$/8,000, where V (mm/s) is the image forming speed, and K is the ratio of the moving speed of the outer peripheral surface of the developing roller to the moving speed of the outer peripheral surface of the image carrying body.

According to the invention, further more, there is provided an image forming apparatus comprising: charging means for charging an image carrying body; exposure means for forming an electrostatic latent image on the image carrying body charged by the charging means; a developing roller located at a distance from the image carrying body and storing a developing agent formed of carrier members having a particle diameter of 30 to 50 μm and toner particles mixed in the carrier members so that the covering rate of the carrier members ranges from 30 to 40%, the stored developing agent being used to develop the electrostatic latent image formed by the exposure means; counting means for counting the frequency in use of the image carrying body and/or the developing agent; and bias voltage applying means for applying a developing bias voltage to the developing roller so that a value obtained by dividing the difference between the developing bias voltage and the potential of the image carrying body exposed by the exposure means by the distance between the image carrying body and the developing means ranges from 60 to 220 (V/mm), wherein the diameter of the developing roller ranges from 2 $(KV)^2$/12,000 to 2 $(KV)^2$/8,000, where V (mm/s) is the image forming speed, and K is the ratio of the moving speed of the outer peripheral surface of the developing roller to the moving speed of the outer peripheral surface of the image carrying body.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

An embodiment of the present invention will now be described in detail with reference to the accompanying drawings.

Figure 1:
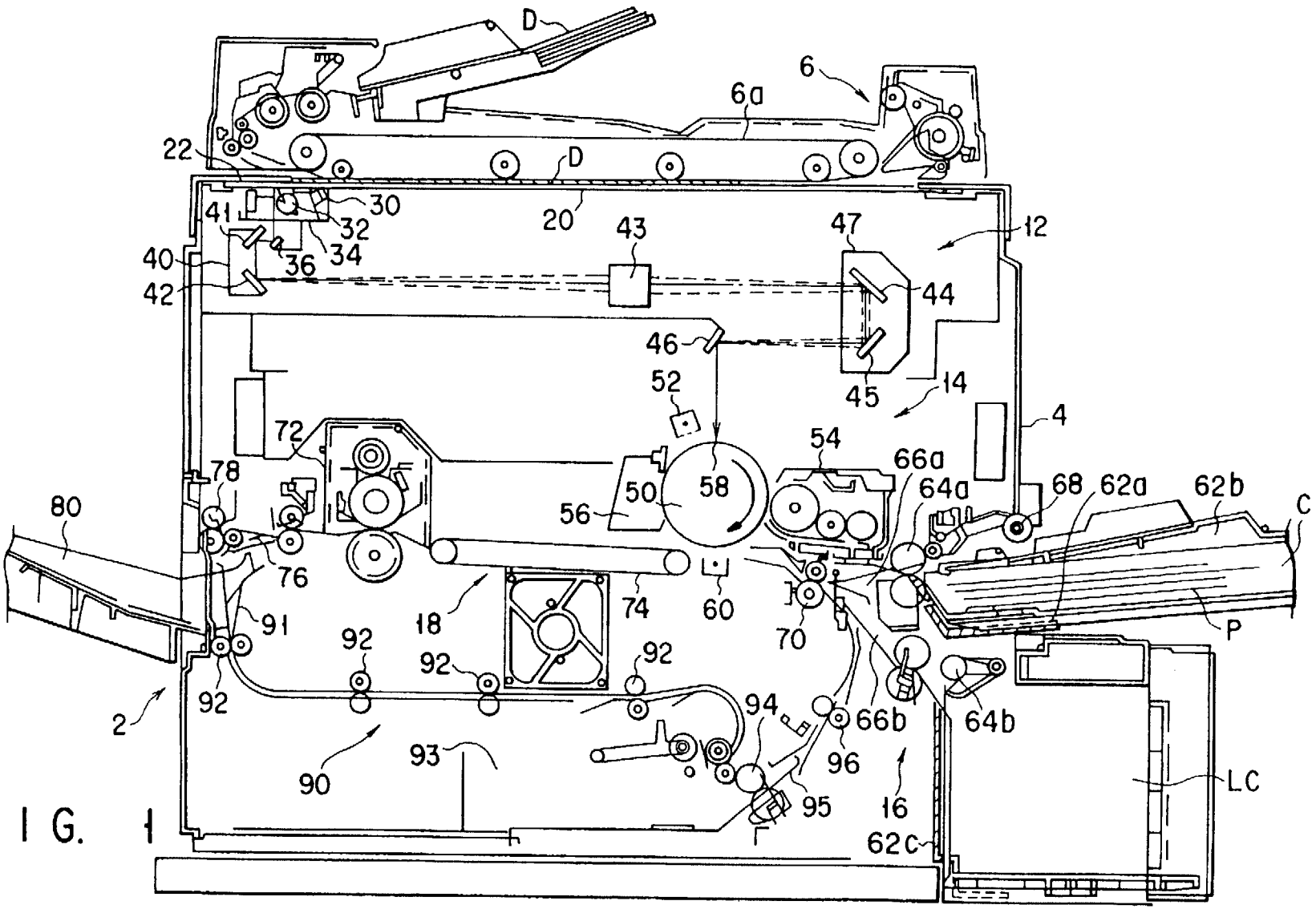
FIG. 1 is a schematic view showing an image forming apparatus according to an embodiment of the present invention.

As shown in FIG. 1, an image forming apparatus i.e., copying apparatus 2 includes an image forming unit i.e., copying apparatus body 4 and an automatic document feeder (hereinafter referred to simply as ADF) 6. The apparatus body 4 serves to copy information corresponding to an image of each document D on a sheet of paper. The ADF 6 overlies the apparatus body 4, and feeds documents D to be copied one after another onto a document table 20, which will be mentioned later.

The copying apparatus body 4 has a document reading unit 12 for reading image information from each document D, an image forming unit 14 for forming an image in accordance with image data read by the reading unit 12 or externally supplied image data, and a sheet of paper feeding unit 16 for feeding sheet of papers that serve to hold the image formed by the image forming unit 14. The apparatus body 4 has a sheet of paper transportation unit 18 for transporting and delivering the sheet of papers, having the image transferred thereto, to the outside of the apparatus.

The document reading unit 12 is composed of the document table 20, first and second carriages 30 and 40 (which will be described below), etc. The table 20 can hold the document D that is situated in a position over the copying apparatus body 4 and opposite a conveyer belt 6*a* of the ADF 6.

The document table 20 is formed of transparent glass with a thickness of 5 mm, for example.

A document stopper plate 22 is provided on that surface (hereinafter referred to as document carrying surface) of one end portion of the document table 20 which carries the document thereon. The plate 22 slightly projects from the document carrying surface of the table 20 as viewed in the sectional direction of the table, in order to stop the leading end of the document D accurately when the document is transported by means of the ADF 6.

First and second carriages 30 and 40 are arranged under the document table 20 so as to be separately movable along the table 20. The first carriage 30, which extends substantially parallel to the table 20, fetches information as the brightness of light from the document D. The second carriage 40 moves following the first carriage 30 and transmits the information fetched by the first carriage 30 to an information recording medium (mentioned later).

The first carriage 30 is provided with an illumination lamp 32 for illuminating the document D, a reflector 34 for converging light from the lamp 32 on the document D and increasing the illumination efficiency, and a first mirror 36 for reflecting reflected light from the document D onto the second carriage 40.

The second carriage 40 is provided with a second mirror 41 for turning back the reflected light from the first mirror 36 at 90° and a third mirror 42 for further turning back at 90° the reflected light from the document D turned back by the second mirror 41.

Below the first carriage 30, a focusing lens 43, fourth and fifth mirrors 44 and 45, and an exposure mirror 46 are arranged within a plane along which the light reflected by the third mirror 42 on the second carriage 40 is transmitted. The focusing lens 43 converges the reflected light from the document D with a magnification corresponding to an inputted copying scale factor. The fourth and fifth mirrors 44 and 45 further turn back the reflected light from the document D that is passed through the lens 43, and guide it to an information storage medium or image carrying body, which will be described later. The mirrors 44 and 45 are designed so as to be movable along an optical axis that passes through the focusing lens 43, within the plane along which the light reflected by the third mirror 42 is transmitted, by means of a mirror holding frame 47 (not described in detail). The mirrors 44 and 45 serve to correct an optical path length (optical distance) between the document table 20 and the image carrying body obtained when the focusing lens 43 is moved according to the copying scale factor.

The image carrying body or a photosensitive drum 50, a drum-shaped photoconductor, which constitutes the kernel of the image forming unit 14, is located substantially in the center of the apparatus body 4 for rotation in a specified direction.

The photosensitive drum 50 is surrounded by a large number of devices and mechanisms that constitute the image forming unit 14, including a main charger 52, developing device 54, cleaning device 56, etc., which are successively arranged in the direction of rotation of the drum 50.

The main charger 52 charges the photosensitive drum 50 so as to obtain a predetermined surface potential.

The developing device 54 feeds toner particles (not shown) to an electrostatic latent image obtained by exposing the surface of the photosensitive drum 50 to light from a laser exposure unit (mentioned later), thereby developing the latent image.

The cleaning device 56 removes toner particles and electric charge remaining on the drum 50.

In the vicinity of the photosensitive drum 50, an exposure position 58 is defined in a space between the main charger 52 and the developing device 54 and on the upstream side of the device 54 with respect to the rotating direction of the drum 50. In the position 58, the reflected light from the document D transmitted to the exposure mirror 46 is applied to the outer periphery of the drum 50 by the mirror 46.

A transfer device 60 is provided between the developing device 54 and the cleaning device 56. The device 60 transfers the toner image formed on the photosensitive drum 50, developed by the developing device 54, to a transfer medium, e.g., sheet of paper P, supplied from a cassette (mentioned later).

A cassette slot 62*a* and an LC cassette slot 62*c* are arranged on the right of the image forming unit 14. A sheet of paper cassette C stored with sheet of papers having a given size and a large-capacity (LC) cassette (described below) are connected to the slots 62*a* and 62*c*, respectively, in order to supply the drum 50 with sheet of papers to be utilized for the transfer and fixing of the toner image formed by the image forming unit 14.

The sheet of paper cassette C, which is stored with the sheet of papers having the given size, is inserted into the cassette slot 62*a*. A bypass tray 62*b* is formed integrally on a top cover of the cassette C. The LC cassette LC, which can store, for example, 2,000 sheet of papers, is set in the LC cassette slot 62*c*.

An upper sheet of paper-supply roller 64*a* and an upper sheet of paper-supply guide 66*a* are arranged between the sheet of paper cassette C (cassette slot 62*a*) and the photosensitive drum 50, and a lower sheet of paper-supply roller 64*b* and a lower sheet of paper-supply guide 66*b* between the LC cassette LC (LC cassette slot 62*c*) and the drum 50. The upper roller 64*a* and guide 66*b* serve to guide each sheet of paper P from the cassette C toward the drum 50. The lower roller 64*b* and guide 66*b* serve to guide each sheet of paper P from the LC cassette LC toward the drum 50. A sheet of paper P set on the bypass tray 62*b* is guided to the upper sheet of paper-supply roller 64*a* for feeding the sheet of paper P from the cassette C through a bypass feed roller 68 that is located close to the roller 64*a*.

Aligning rollers 70 are arranged between the upper sheet of paper-supply guide 66*a* and the photosensitive drum 50. The rollers 70 correct a skew of the sheet of paper P by suspending the feed of the sheet of paper from the sheet of paper cassette C, bypass tray 62*b*, or LC cassette LC. Also, the rollers 70 serve to align the respective leading end positions of the sheet of paper P and the toner image that is formed on the surface of the drum 50 and is transported toward the transfer device 60 as the drum 50 rotates.

A fixing device 72, transportation device 74, branch gate 76, exit rollers 78, and tray 80 are arranged on the left of the image forming unit 14. The fixing device 72 fixes the toner image on the sheet of paper P to which the toner image is transferred from the photosensitive drum 50 by the transfer device 60. The transportation device 74 is located between the fixing device 72 and the transfer device 60, and feeds the sheet of paper P having the transferred toner image thereon toward the fixing device 72. The gate 76 guides the sheet of paper P having the image fixed thereto by the fixing device 72 to the outside of the copying apparatus body 4 or a sheet of paper reversal unit 90 (mentioned later). The exit rollers 78 deliver the sheet of paper P guided by the gate 76 to the outside of the apparatus body 4. The tray 80 serves to hold the discharged sheet of paper P.

Located below the image forming unit 14 is the sheet of paper reversal unit 90, which reverses the sheet of paper P distributed by the branch gate 76, and then guides it again to the aligning rollers 70.

The sheet of paper reversal unit 90 has a reversal guide 91 for guiding the sheet of paper P having the toner image previously formed on one side thereof, transportation rollers 92 arranged with a given space defined depending on the size of the reversible sheet of paper P, and a storage region 93 capable of temporarily storing the sheet of paper P guided by the reversal guide 91 and the transportation rollers 92. The reversal unit 90 has reverse sheet of paper-supply rollers 94 for transporting the sheet of paper P in the storage region 93 toward the aligning rollers 70, a reverse sheet of paper-supply guide 95 for guiding the sheet of paper P drawn out from the rear end side by means of the rollers 94, and intermediate transportation rollers 96 for propelling the sheet of paper P passed through the guide 95 toward the aligning rollers 70.

Figure 2:
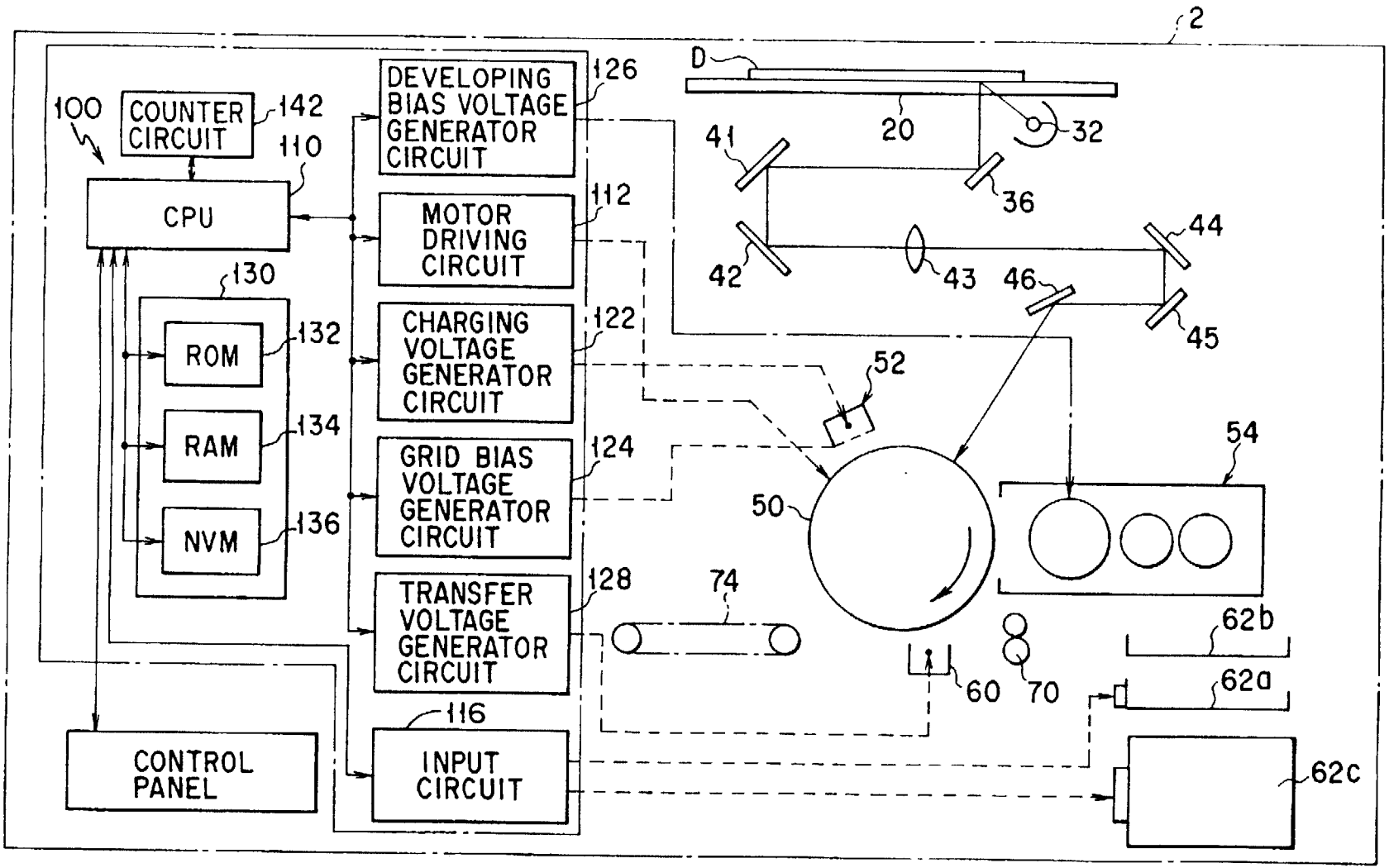
FIG. 2 is a block diagram showing control blocks in a principal part of the image forming apparatus of FIG. 1.

FIG. 2 schematically shows control blocks for electrical connection and control of various parts of the copying apparatus shown in FIG. 1.

As shown in FIG. 2, a control section 100 includes a CPU (central processing unit) 110 for use as a main control section.

The CPU 110 is connected with a motor driving circuit 112, lens position control circuit (not shown), input circuit 116, etc. The motor driving circuit 112 causes a main motor (not shown), scanning motor (stepping motor, not shown), developing motor, etc. to rotate independently of or in combination with one another. The main motor rotates the photosensitive drum 50 so that the outer peripheral surface of the drum 50 moves at a given speed. The scanning motor causes the first and second carriages 30 and 40 to move along the document table. The developing motor is used to rotate a developing roller of the developing device. The control circuit controls a lens motor (not shown) for moving the focusing lens 43 to a position corresponding to the inputted copying scale factor. The input circuit 116 fetches output signal from a lot of sensors (not shown) and delivers them to the CPU 110.

Further, the CPU 110 is connected with a voltage charging voltage generator circuit 122 for supplying charging voltage to the main charger 52, a grid bias voltage generator circuit 124 for applying a given grid bias voltage to the charger 52, a developing bias voltage generator circuit 126 for applying a given developing bias voltage to the developing device 54, and a transfer voltage generator circuit 128 for applying transfer and separation voltages (AC) to the transfer device 60.

The CPU 110 is also connected with a memory unit 130, which is stored with predetermined initial data, adjustment data inputted through, for example, a control panel (not shown) when the apparatus body 4 is assembled, and other data. The memory unit 130 includes a read-only memory (ROM) 132, random access memory (RAM) 134, and non-volatile memory (NVM) 136. The ROM 132 is previously stored with predetermined numerical data, control data for operating the apparatus 2, etc. The RAM 134 temporarily stores copying condition data and the like that are inputted through the control panel. The NVM 136 stores adjustment data inputted when the copying apparatus 2 is assembled, e.g., reference voltage for lighting the illumination lamp 32.

Driving pulses supplied from the motor driving circuit 112 to the main motor (not shown) are added up on occasion by, for example, a counter 142 (counter devices 201 and 202 mentioned later with reference to FIG. 14), and are updated and stored in specified regions of the NVM 136 and the RAM 134. Based on the stored driving pulses, a frequency equivalent to a cumulative time for the rotation of the photosensitive drum 50 and a cumulative time (developing agent application time) for image forming are measured.

According to the present embodiment of the invention, the developing bias voltage and the amount of charge on the photosensitive drum 50 are controlled in accordance with the cumulative time for image forming, which will be described in detail later.

The following is a description of features of the operation of the copying apparatus shown in FIGS. 1 and 2.

As shown in FIG. 1, the document D, which is set in position on the document table 20 by automatic feeding by means of the ADF 6 or by a user, is brought intimately into contact with the table 20 as the conveyer belt 6*a* of the ADF 6 rotates.

An image of the document on the document table 20 is illuminated by the illumination lamp 32 and the reflector 34, and the resulting reflected light is reflected by the first mirror 36 on the first carriage 30 and the second and third mirrors 41 and 42 on the second carriage 40 in the order named, and transmitted through the focusing lens 43. Further, the transmitted light is reflected by the fourth and fifth mirrors 44 and 45 and the exposure mirror 46 in the order named, and applied to the outer peripheral surface of the photosensitive drum 50 in the exposure position 58. The focusing lens 43 is moved to a predetermined position corresponding to the copying scale factor inputted through the control panel (not shown) before the lighting of the illumination lamp 32 and the movement of the first carriage 30 (second carriage 40).

As or just before the aforesaid reflected light from the document D is guided to the photosensitive drum 50, the outer peripheral surface of the drum 50 is charged to the specified surface potential by the main charger 52 that is energized by the charging-voltage generator circuit 122.

When the reflected light from the document D, reflected by the exposure mirror 46, is applied to the exposure position 58 on the outer peripheral surface of the photosensitive drum 50 in this state, an electrostatic latent image is formed the drum surface.

The latent image thus formed on the drum 50 is developed as a toner image by the toner particles fed through the developing device 54, and the developed image is transferred to the sheet of paper P by the transfer device 60.

The sheet of paper P having the transferred toner image thereon is transported to the fixing device 72 by the transportation device 74. After the toner image or toner particles are fixed by means of heat provided by the fixing device 72, the sheet of paper P is guided to the sheet of paper reversal unit or the outside of the apparatus 2.

After delivering the toner image to the sheet of paper P, the photosensitive drum 50 is cleared of the electric charge and toner particles remaining on its surface by the cleaning device 56, and is then used in the next cycle of image forming.

In the case where two or more copies are expected to be made or when another document is supplied, the aforesaid series of copying processes is repeated.

The following is a detailed description of the developing device, developing conditions, developing agent, and toner particles suited to the copying apparatus shown in FIGS. 1 and 2.

As mentioned before, it is revealed that scattering of the toner particles, which also depends on the toner concentration, is caused mainly when low-charged toner particles are blown away by centrifugal force that is produced as the developing roller rotates.

According to the present invention, therefore, the capacity for toner supply to the photosensitive drum 50 is improved by using a small-particle carrier members, and the rotating speed of the developing roller is adjusted to a low level. The adhesion of the small-particle is reduced by suitably adjusting the difference between a contrast potential or developing bias voltage Vb and a non-image region potential Vw on the drum 50. The non-image region potential Vw is the potential of a non-image region (the background, i.e., a white region) in a normal developing system, on which the light from the mirror 46 is reflected. With use of the aforesaid developing agent with a high developing efficiency, moreover, the peripheral speed ratio and diameter of the developing roller can be minimized.

The following is a detailed description of conditions for preparing the high-efficiency developing agent.

The toner concentration must be increased in order to maximize the toner supply capacity. However, the toner concentration cannot be increased unlimitedly, and the toner particles must be fully charged by friction as it is blended with the carrier members.

Figure 3:
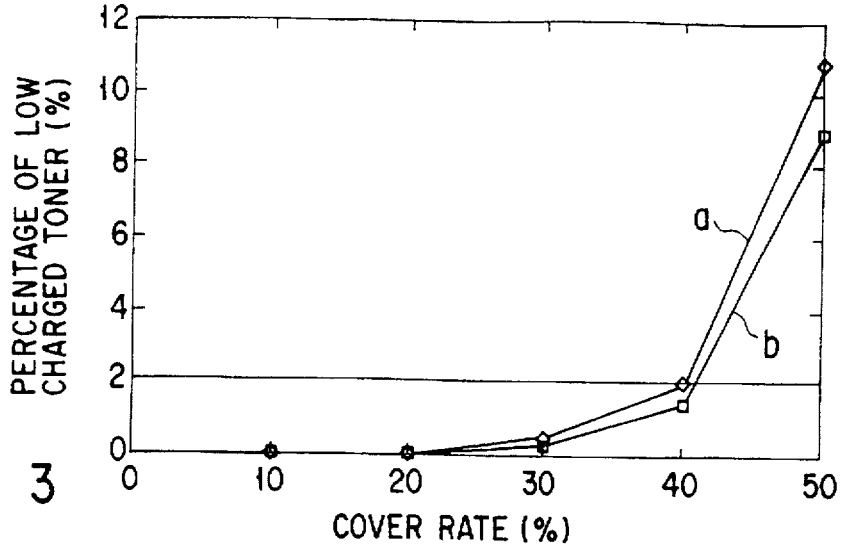
FIG. 3 is a graph showing the relations between covering rate of toner particles on the surface of carrier members and percentages of the low charged-toner particles are generated.

Thus, when the toner particles meet the carrier members, it should be able to get about freely enough on the carrier members. Preferably, the covering rate, which is indicative of the extent to which the toner particles adheres to the outer peripheral surface the carrier members, should range from about 30 to 50%, as shown in FIG. 3, in order to subject the toner particles to satisfactory frictional charging. The covering rate is described in "Quality-image ordinary-paper copying machine using a new process and developing agent" in National Technical Report Vol. 28, No. 4, August 1982. The covering rate is given by $$E=100.C.\rho c.dc.S/\pi.(100-C).\rho t.dt^3, \quad (1)$$

$$S=\pi dc^2.[1-\{\sqrt{dc(dc+2dt)}/dc+dt\}], \quad (2)$$

where E is the covering rate, ρc is the density (g/cm$^3$) of the carrier members, ρt is the density (g/cm$^3$) of the toner particles, C is the toner concentration (% by weight), dc is the average diameter (cm) of the carrier members, and dt is the average diameter (cm) of the toner particles.

FIG. 3 shows relations between the carrier members covering rate and the incidence of the low-charged toner particles.

In FIG. 3, curves a and b represent cases in which the average diameter of the carrier members is 30 μm and 50 μm, respectively.

The results shown in FIG. 3 were obtained by using LEODRY-2540, an electronic copying machine produced by Toshiba Corporation. A silicon-based coating carrier members was used as the carrier members, and a styrene-acrylic toner particles with the average diameter of 11 μm as the toner particles.

As seen from FIG. 3, the percentage of the low-charged toner particles are settle depending on the covering rate without regard to the average diameter of the carrier members, and the covering rate should preferably be adjusted to 40% or less with the average carrier members diameter of the carrier members ranging from 30 to 50 μm in order to reduce the quantity of the low-charged toner particles.

If the toner concentration is too low, in contrast with this, the toner particles are in short supply, so that a satisfactory image density cannot be obtained. In consideration of variability of the toner concentration in the developing device, the covering rate should preferably be set at 30 to 40%.

Thus, the covering rate is adjusted to 30 to 40%, and the toner concentration in the developing device is settled so as to obtain the covering rate of 30 to 40% according to expression (1) based on the respective particle diameters and densities of the carrier members and the toner particles.

Figure 4:
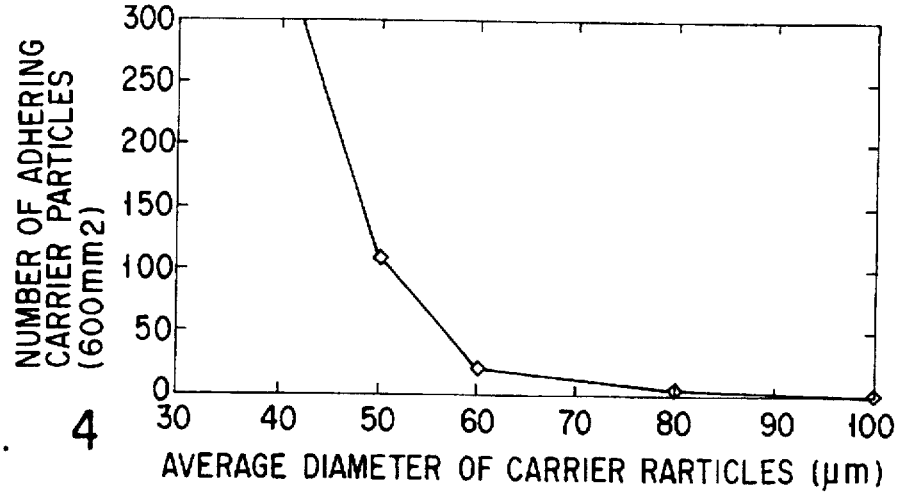
FIG. 4 is a graph showing the relation between the average diameters of the carrier members and the number of carrier members particles adhering to a photosensitive drum.
Figure 5:
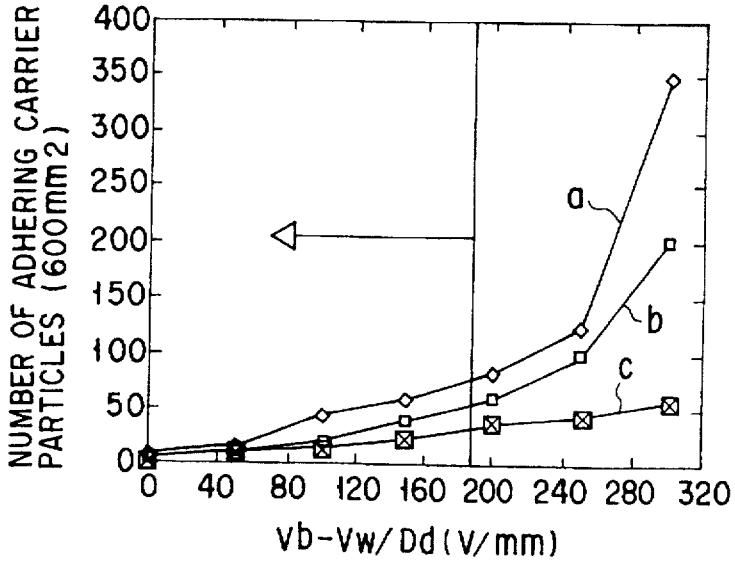
FIG. 5 is a graph showing relations between the contrast potential, (Vb–Vw)/Dd [V/mm], obtained with use of the average diameters of the carrier members as a parameter, and the number of adhering carrier members.

In consideration of the toner concentration, as mentioned before, the carrier members should preferably have a smaller average diameter of the carrier members that ensures a greater surface area. As shown in FIG. 4, however, a larger average particle diameter of the carrier members (50 μm or more) is advantageous in preventing the carrier members from adhering to the surface of the photosensitive drum 50. Actually, the carrier members adhere to the surface of the drum 50 depending on the contrast potential (anti-blushing electric field) or (Vb−Vw)/Dd that is defined by the difference between the none-image region potential Vw on the drum surface and the developing bias voltage Vb applied to the developing agent by the developing device and a distance Dd between the drum 50 and the developing roller. Accordingly, available conditions for carrier members with a smaller diameter (30 μm or more) can be provided by optimally setting the intensity of the developing field, as shown in FIG. 5. In FIG. 5, curves a, b and c represent cases in which the average diameter of the carrier members is 30 μm, 40 μm, and 50 μm, respectively. Testing conditions for the results shown in FIG. 5 are identical with those for the results shown in FIG. 3. As seen from FIG. 5, the contrast potential for carrier members with the average diameter of the carrier members of 30 to 50 μm should be adjusted to 220 (V/mm) in order to prevent the carrier members from adhering to the photosensitive drum 50. Preferably, the contrast potential is adjusted to 180 (V/mm).

Figure 6:
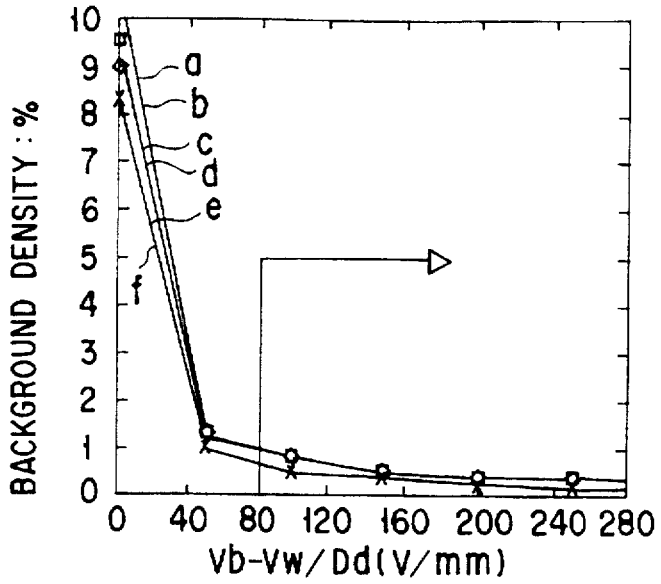
FIG. 6 is a graph showing relations between the contrast potential and the change of the background density, obtained when the respective average diameters of the carrier members and toner particles are changed, for the case of an initial state in which the total frequency of image forming is lower than a given value.

On the other hand, FIG. 6 is a graph showing results of measurement of the change of the value of fog compared with the contrast potential (anti-blushing electric field) or (Vb−Vw)/Dd, obtained when the respective average diameters of the carrier members and the toner particles are changed. The graph of FIG. 6 is related to an initial state in which neither of the developing agent and the photosensitive drum is subject to change with time, that is, the total frequency of image forming is lower than a given value.

In FIG. 6, curves a, b, c, d, e and f represent developing agents with the carrier members and toner particles average diameters of 30 μm and 7 μm, 40 μm and 7 μm, 50 μm and 7 μm, 30 μm and 12 μm, 40 μm and 12 μm, and 50 μm and 12 μm, respectively. Curves a, c and e are substantially identical with curves b, d and f, respectively.

Figure 7:
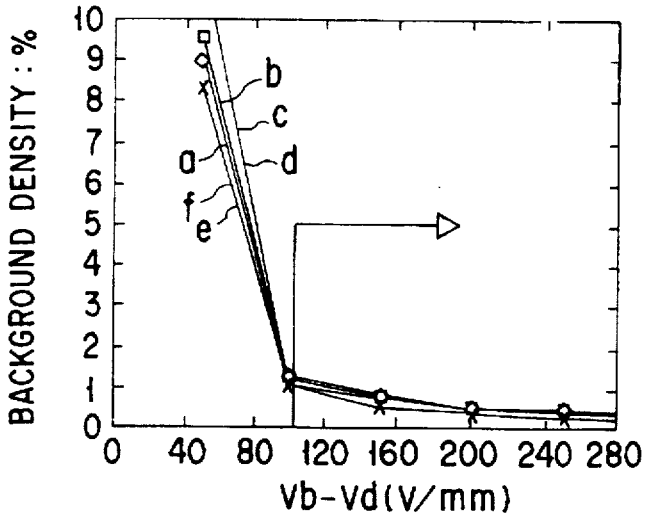
FIG. 7 is a graph showing background density indicative of changes of a developing agent and the photosensitive drum with time observed when 100,000 images are formed on A4-size sheet of papers under the same conditions for the results shown in FIG. 6.

FIG. 7 shows results of measurement of the fog caused when 100,000 images are formed on A4-size sheet of papers under the same conditions for the results shown in FIG. 6. In FIG. 7, curves a, b, c, d, e and f represent the developing agents with the carrier members and toner particles average diameters of 30 μm and 7 μm, 40 μm and 7 μm, 50 μm and 7 μm, 30 μm and 12 μm, 40 μm and 12 μm, and 50 μm and 12 μm, respectively. Curves d and f are substantially identical with curves c and e, respectively.

As seen from FIGS. 6 and 7, the optimum contrast potential for the prevention of the fog varies depending on the state, initial or live. Satisfactory developing can be achieved with use of the contrast potential at 60 (V/mm), preferably 80 (V/mm) or more.

As seen from FIGS. 6 and 7, moreover, adhesion of the carrier members to the photosensitive drum 50 and the fog can be prevented with use of carrier members having the contrast potential of 60 to 280 (V/mm), particle diameter of 30 to 50 μm, and covering rate of 30 to 40%.

The toner supply capacity is rationalized by using the developing agent whose carrier members average diameter of the carrier members, covering rate, and contrast potential are set in the aforesaid manner. The following is a description of relations between centrifugal force, which is closely related with those factors, and scattering of the toner particles and between the toner supply capacity and image density.

Figure 8:
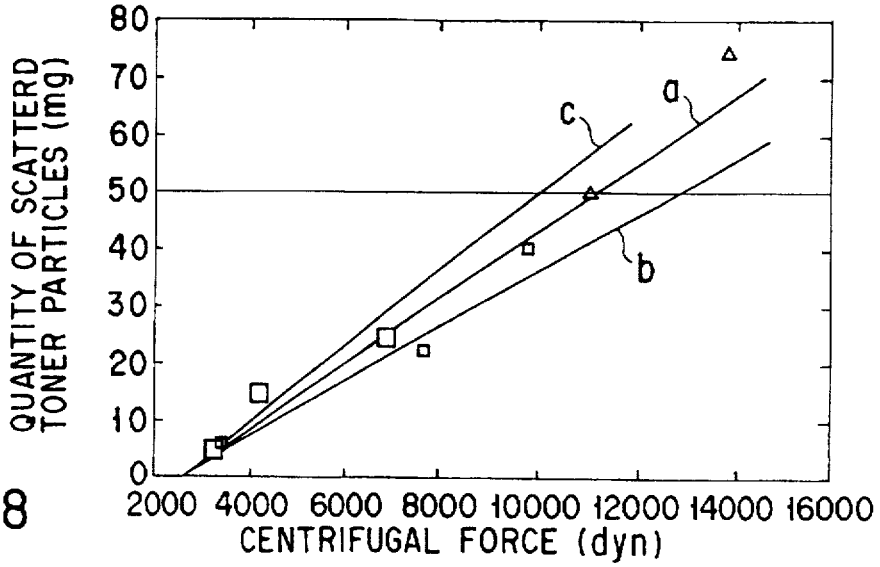
FIG. 8 is a graph showing relations between the average diameters of the carrier members and centrifugal force acting on the carrier members.

FIG. 8 shows relations between the scattering of the toner particles and centrifugal force, which will be described first. A developing agent that is equal in properties to the aforesaid one was used, and the average diameter of the carrier members was 50 μm. Forty thousand images were formed on A4-size sheet of papers by using LEODRY-2540, LEODRY-4550, and LEODRY-6550, electronic copying apparatuses produced by Toshiba Corporation, and toner particles dropped in the lower part of the developing device were extracted. It is empirically known that 50 mg or less of scattered toner particles cannot exceed a practical maximum allowable value for the value of scattering of the toner particles.

In FIG. 8, curves A, B and C represent cases in which sleeve diameter, that is, the outside diameter of the developing roller of the developing device 54, is 20 mm, 38 mm, and 50 mm, respectively.

If the centrifugal force per unit weight of the developing agent is smaller than about 12,000 dyn, as seen from FIG. 8, the value of scattering of the toner particles cannot exceed the maximum allowable value without regard to the sleeve diameter (outside diameter of the developing roller).

Thus, it is evident that the diameter Φ (mm) of the developing roller can be given by $$2\,(KV)^2/\Phi \leqq 12{,}000, \tag{3}$$

where K and V are the peripheral speed ratio and processing speed, respectively.

An actual copying apparatus is provided with a fan as a cooling device therein, in order to prevent the image forming members from being adversely affected by an increase in temperature in the apparatus. In some cases, however, this fan may promote the toner particles scattering. It is evident from experience that the value of the promotion of the toner particles scattering by the fan, which varies according to the construction of the copying apparatus, ranges from 0 to about 40%.

In consideration of the promotion of the toner particles scattering by the fan, therefore, the centrifugal force for preventing the toner particles scattering must be reduced by about 40%. Thus, it is necessary only that the sleeve diameter (outside diameter of the developing roller) be set within a range, $$8{,}000 \leqq 2\,(KV)^2/\Phi \leqq 12{,}000 \tag{4}$$

Figure 9:
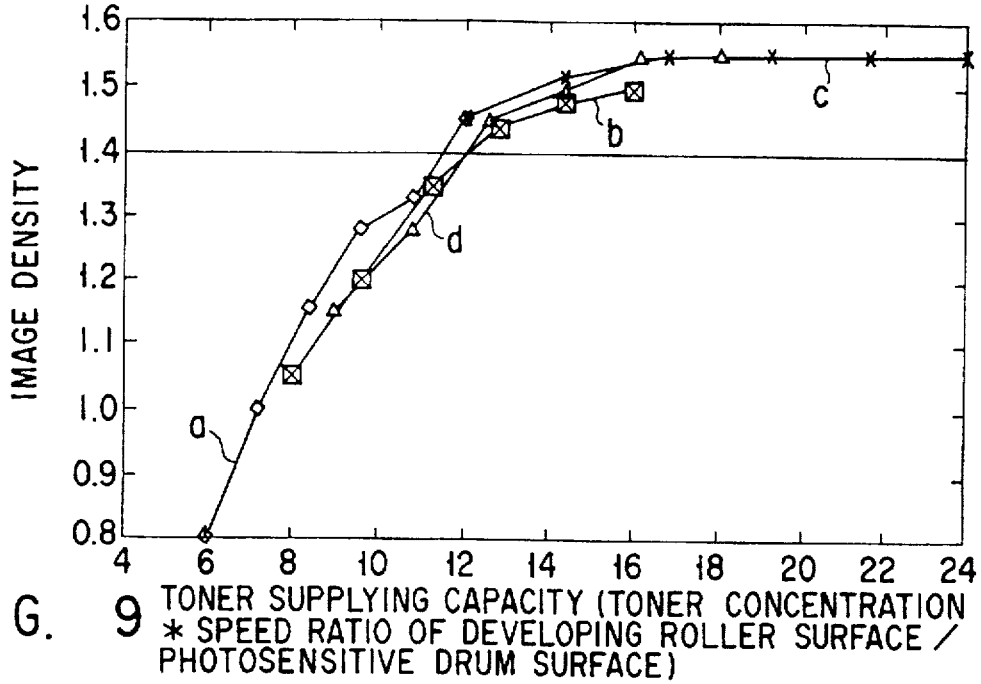
FIG. 9 is a graph showing relations between the toner supply capacity (product of the toner concentration and the ratio of the moving speed of the outer periphery of a developing sleeve to the moving speed of the outer periphery of the photosensitive drum) and the image density.

On the other hand, FIG. 9 is a graph showing relations between the image density and the toner supply capacity, that is, the product of the toner concentration and the ratio of the moving speed of the outer periphery of the developing roller to that of the photosensitive drum. In FIG. 9, curve a represents an image density provided by a developing agent that is prepared by mixing toner particles with the average diameter of the toner particles of 7 μm into carrier members with the average diameter of the carrier members of 40 μm in the ratio of 6% by weight. Curve b represents an image density provided by a developing agent that is prepared by mixing toner particles with the average diameter of the toner particles of 12 μm into carrier members with the average diameter of the carrier members of 50 μm in the ratio of 8% by weight. Curve c represents an image density provided by a developing agent that is prepared by mixing toner particles with the average diameter of the toner particles of 12 μm into carrier members with the average diameter of the carrier members of 30 μm in the ratio of 12% by weight. Curve d represents an image density provided by a developing agent that is prepared by mixing toner particles with the average diameter of the toner particles of 11 μm into carrier members with the average diameter of the carrier members of 40 μm in the ratio of 9% by weight.

If the toner supply capacity is greater than about 12, as seen from FIG. 9, the image density exceeds 1.4 without regard to the toner concentration, even though the carrier members and the toner particles combined therewith have different average diameters. The results shown in FIG. 9 are obtained independently of the diameter and rotational frequency (sleeve peripheral speed) of the developing roller that satisfy the relations with the centrifugal force shown in FIG. 8. Accordingly, these results indicate that the image density (ID) hardly depends on the developing roller diameter and the processing speed, but depends on the product of the toner concentration (Tm) and the peripheral speed ratio (k). Thus, we have $$\mathrm{ID}\ \mathrm{Tm}\times k. \tag{5}$$

Since the toner concentration can be obtained appropriately from the diameter of the carrier members, covering rate, and other factors and according to expressions (1) and (2), the minimum necessary peripheral speed ratio k for the maintenance of the image density ID can be obtained according to expression (5).

Since the centrifugal force is given by 2 $(KV)^2/\Phi$ of expression (3), the toner particles can be prevented from scattering by setting the diameter $\Phi$ (mm) so as to fulfill expression (3).

Accordingly, the minimum value of the diameter $\Phi$ (mm) of the developing roller, based on expression (3), is obtained definitely as $$\Phi=2\ (KV)^2/12{,}000. \tag{6}$$

For the same reason as the one described in connection with expression (4), expression (6) can be transformed into $$2\ (KV)^2/12{,}000 \leqq \Phi \leqq 2\ (KV)^2/8{,}000, \tag{7}$$

in the case where the magnitude of the centrifugal force ranges from 8,000 to 12,000 (dyn).

Thus, the apparatus can be reduced in size by setting the average diameter of the carrier members, covering rate, and contrast potential within appropriate ranges and then setting the minimum roller diameter $\Phi$ so as to fulfill expression (7) in order to prevent scattering of the toner.

For actual determination, a developing roller with $\Phi$=20 mm was incorporated into a testing apparatus obtained by remodeling LEODRY-3240, an electronic copying apparatus produced by Toshiba Corporation, and a developing agent was prepared by mixing 9% (by weight) of styrene-acrylic toner particles members (carbon ratio: 6%, charging control agent: 0.5%, silica: 0.5%) with the average diameter of 10.5 μm from Toshiba Corporation into coating carrier members with the average diameter of the carrier members of 40 μm from Kanto Denka Co., Ltd. Using this developing agent, images were formed on A4-size sheet of papers at a processing speed V of 205 mm/s and with a surface potential Vo of −600 volts, developing bias voltage Vb of −100 volts, and peripheral speed ratio k of 1.4, and the quantity of scattered toner particles was measured. The photosensitive drum used is an article made on an experimental basis and given a sensitivity equal to that of the photosensitive drum used in the Toshiba's electronic copying apparatus LEODRY-4550.

When 100,000 such images were formed under the aforesaid conditions, 75 mg of toner particles scattered. This figure is improved or lowered to 60%, as compared with 50 mg, the maximum allowable value for the quantity of toner particles scattered during the formation of 40,000 images described with reference to FIG. 8.

As described above, satisfactory developing can be achieved by setting the average diameter of the carrier members, covering rate, contrast potential, developing roller diameter, etc. within appropriate ranges. However, variations of the charging capacity of the photosensitive drum, e.g., physical or chemical changes that accompany optical fatigue, changes in temperature and humidity, and increase of the frequency of image forming, cause changes in the surface potential Vo and potential attenuation value (value of residual potential attributable of dark attenuation after the passage of a given time) of the photosensitive drum. These changes of the surface potential Vo and potential attenuation value of the drum cause the none-image region potential Vw of the drum to changes so that (Vb−Vw), which is associated with the contrast potential, also changes. With use of the same charging potential (output of the main charger to produce the surface potential Vo) and contrast potential as those for the initial state, therefore, the fog may be increased, or the image density may be lowered. Likewise, the amount of charge on the developing agent change as the developing agent is degenerated after prolonged use. If the control is effected under the same conditions for the initial state, therefore, the developing agent is also subject to the problems of the increased blushing density and lowered image density.

Since the none-image region potential Vw cannot be controlled directly, however, a method may possibly be used to control it by changing the developing bias voltage Vb so that (Vb−Vw)/Dd ranges from 60 to 220 (V/mm). If the developing bias voltage Vb is changed, it influences the contrast of the image that depends on the difference between the surface potential Vo of the photosensitive drum and the voltage Vb. It is to be understood, therefore, that the surface potential Vo of the drum should be also changed when the bias voltage Vb is changed.

Figure 14:
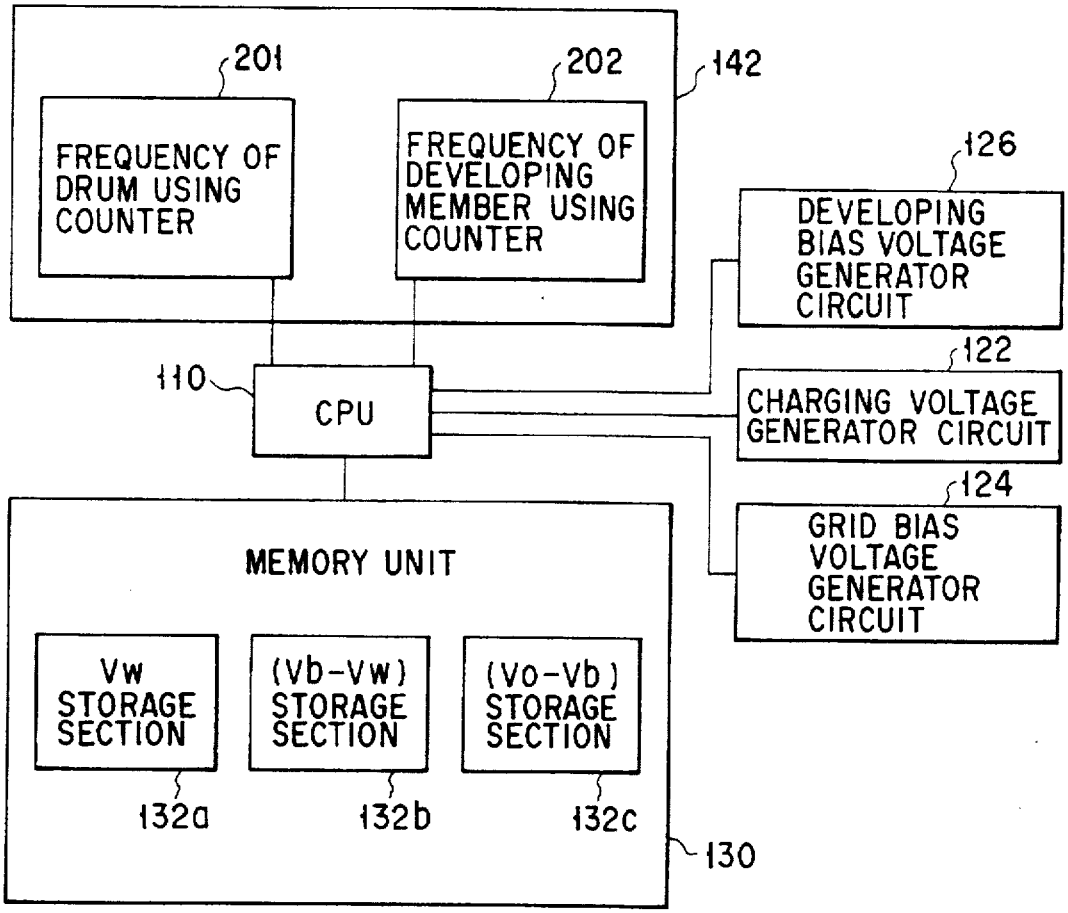
FIG. 14 is a block diagram showing an example of a control unit for changing the surface potential of the photosensitive drum and the developing bias voltage as a cycle of image forming is repeated.

FIG. 14 is a block diagram (sharing part with the block diagram of FIG. 2) showing a control unit for changing the surface potential Vo of the photosensitive drum and the developing bias voltage Vb as the cycle of image forming is repeated.

As seen from FIG. 14, the control unit includes the frequency of drum using counter 201 and the frequency of developing agent using counter 202 for counting the frequencies (extents) in use of the photosensitive drum and the developing agent, respectively. The counter 201 and 202, which are provided individually for the photosensitive drum and the developing agent, can be replaced independently of each other when exhausted if the respective life spans of the drum and the developing agent are not equal.

The counter 201 and 202 count the respective frequencies in use of the photosensitive drum and the developing agent. If the drum and/or the developing agent is replaced, each corresponding counter is reset by reset inputting through the control panel.

Figure 10:
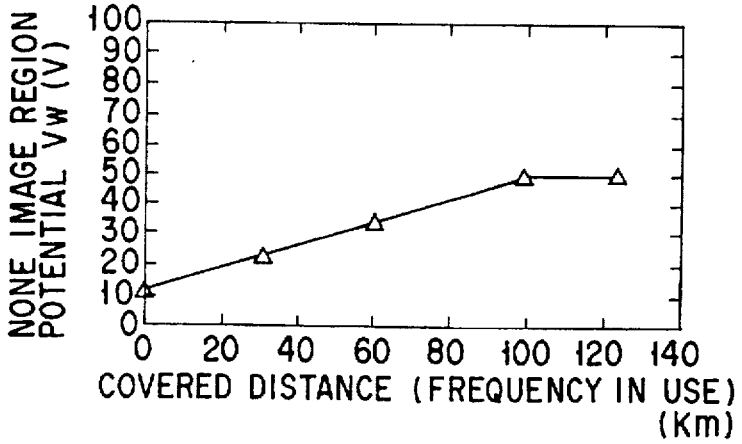
FIG. 10 is a graph showing change of none image region potential of the photosensitive drum with time, compared with the total frequency of image forming in terms of a frequency in use or covered distance defined as the photosensitive drum is rotated.

The ROM 132 (or NVM 136) of the memory unit 130 is previously stored with estimated values of the none-image region potential Vw of the photosensitive drum that varies as the frequency of image forming increases or changes with time. Likewise, estimated values of (Vb−Vw) and (Vo−Vb) that are needed to restrict the anti-blushing electric field within a fixed range (60 to 220 V/mm) are also stored as the frequency changes with time. Those estimated values are set in accordance with the change of Vw previously described with reference to FIG. 10.

Data stored in individual storage regions are fetched as motor driving pulses supplied to the motor driving circuit 112 are counted by the counter devices 201 and 202 shown in FIG. 2 (or FIG. 14), and as the data are referred to with every predetermined number of pulses.

Figure 15:
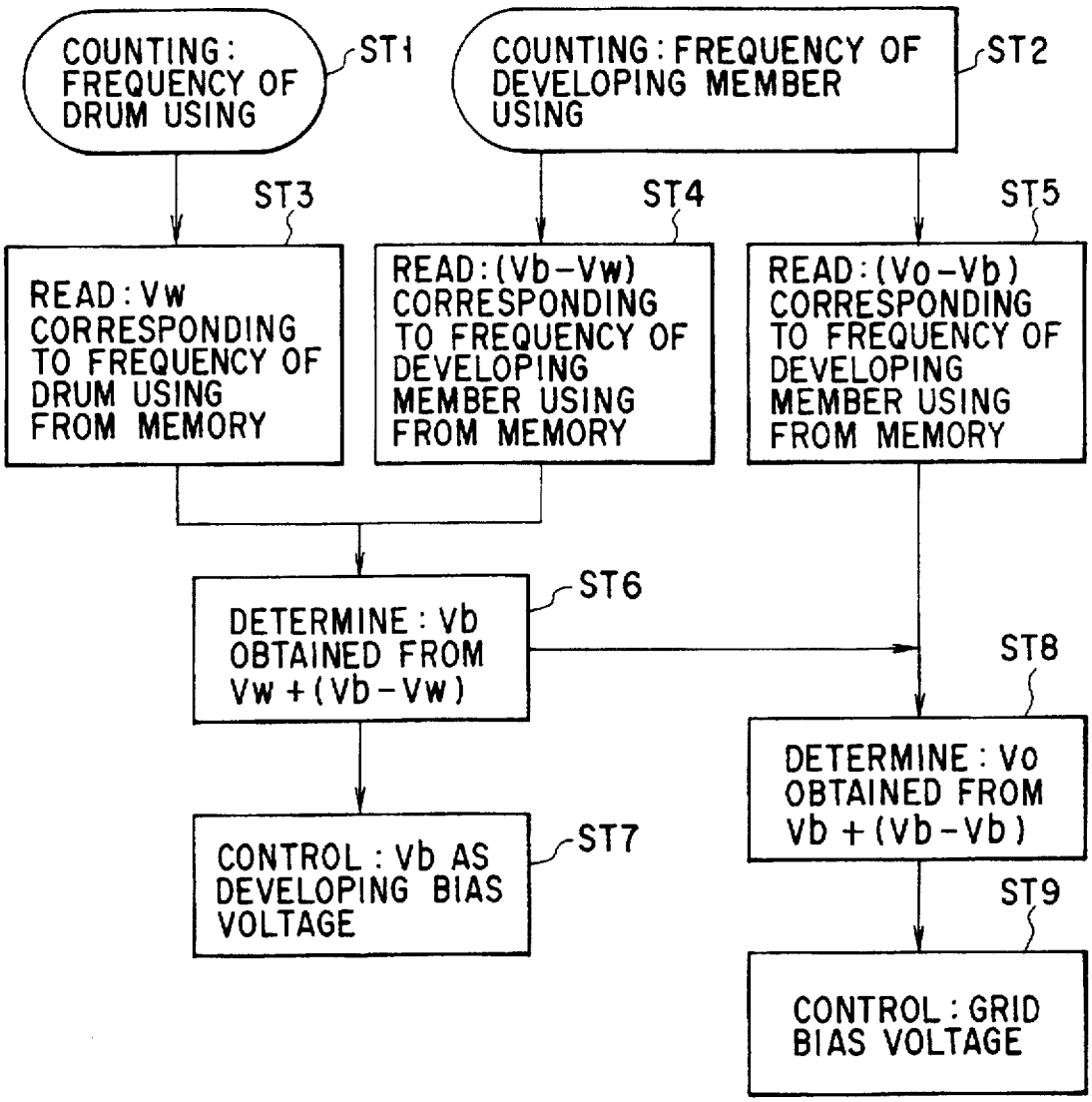
FIG. 15 is a flowchart for illustrating flows of control for changing the surface potential of the photosensitive drum and the developing bias voltage as the image forming is repeated by means of the control unit shown in FIG. 14.

FIG. 15 is a flowchart for illustrating flows of control for changing the surface potential Vo of the photosensitive drum and the developing bias voltage Vb as the cycle of image forming shown in FIG. 14 is repeated.

As shown in FIG. 15, Vw, (Vb−Vw), and (Vo−Vb) corresponding to the accumulation of image forming are read out individually from specified regions of the ROM 132 (or NVM 136) (Steps ST3, ST4 and ST5) when the image forming is carried out to some extent (Step ST1 for drum use frequency counting; Step ST2 for developing agent use frequency counting).

Vb is obtained by adding up the read Vw and (Vb−Vw) (Step ST6).

In order to use Vb obtained in Step ST6 as the developing bias voltage, a specific control signal is delivered from the CPU 110 to the developing bias voltage generator circuit 126.

Subsequently, Vo is obtained (Step ST8) in accordance with Vb obtained in Step ST6 and (Vo–Vb) read in Step ST5.

A specific control signal is delivered from the CPU 110 to the grid bias voltage generator circuit 124 (Step ST9) so that Vo obtained in Step ST8 is the surface potential of the photosensitive drum.

Thus, by changing the developing bias voltage and the surface potential of the photosensitive drum in consideration of aging or changes with time, the increase of fog and reduction of the image density, which are attributable to changes of the properties of the drum or the developing agent, can be compensated.

Figure 11:
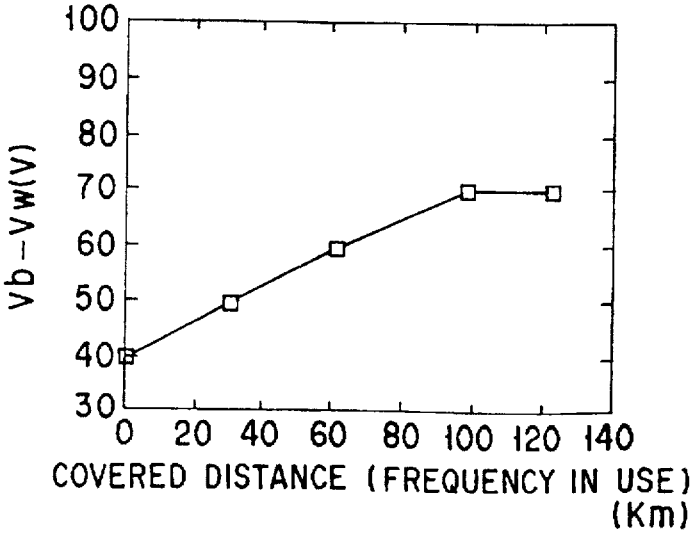
FIG. 11 is a graph showing variation of the contrast potential (Vb–Vw)/Dd based on change of the properties of the photosensitive drum with time, compared with the total frequency of image forming in terms of a frequency in use or covered distance defined as the drum is rotated.

FIG. 11 is a graph illustrating an example of the control shown in the flowchart of FIG. 15 and showing variation of a fog prevented electric field (Vo–Vw)/Dd. In FIG. 11, the axis of abscissa represents the frequency of image forming in terms of time.

Figure 12:
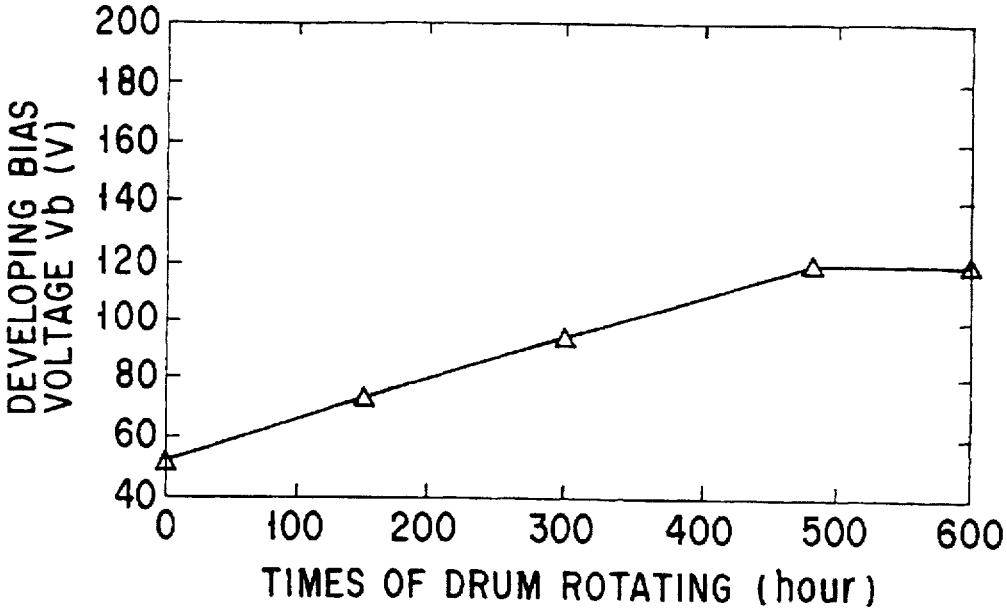
FIG. 12 is a graph showing variation of the magnitude of a developing bias voltage Vb to be changed in order to compensate the change of the properties of the photosensitive drum with time.
Figure 13:
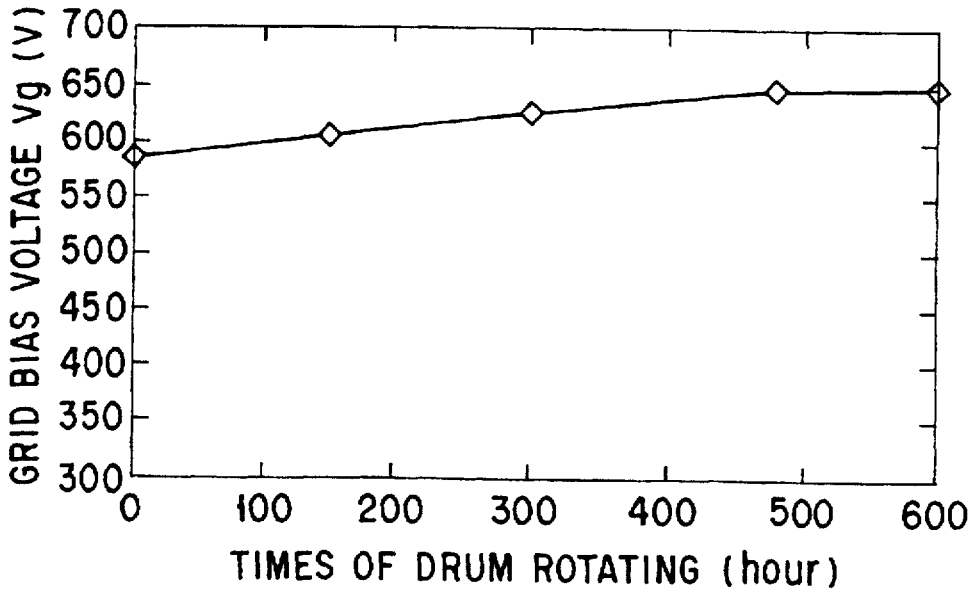
FIG. 13 is a graph showing variation of the magnitude of a grid bias voltage Vg of a main charger to be changed in order to compensate the change of the properties of the photosensitive drum with time.

The actual developing and grid bias voltages are changed in the manners shown in FIGS. 12 and 13, respectively.

According to the present invention, as described herein, the average diameter of the carrier member, the average diameter of the toner particles, toner concentration, developing roller diameter, and developing roller peripheral speed are optimized, so that the apparatus can be reduced in size as the developing roller diameter is reduced. Despite the small diameter of the developing roller, moreover, a high image density can be secured, and the value of scattering the toner can be lowered.

The image density can be kept constant, moreover, since a decrease of the contrast potential difference can be compensated with the respective changes of the developing bias voltage and the grid bias voltage.

Thus, there may be provided an image forming apparatus that suffers less toner particles scattering and a narrower variation in image density.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

We claim:

1. An image forming apparatus comprising:

charging means for charging an image carrying body;

exposure means for forming an electrostatic latent image on the image carrying body charged by the charging means;

developing means opposed to the image carrying body and adapted to supply a developing agent to the latent image formed by the exposure means, thereby developing the image;

developing bias voltage applying means for applying a developing bias voltage to the developing means; and voltage control means for controlling the charging by the charging means and the voltage applied by the developing bias voltage applying means so that a value obtained by dividing the difference between the developing bias voltage and a non-image region potential of the image carrying body by a distance between the image carrying body and the developing means ranges from 60 to 220 (V/mm).

2. An image forming apparatus according to claim 1, further comprising:

counting means for counting a frequency in use of the image carrying body and/or the developing agent; and wherein said voltage control means controls an amount of charge by the charging means and the developing bias voltage in accordance with the frequency counted by the counting means so that a value obtained by dividing the difference between the developing bias voltage and the potential of the image carrying body exposed by the exposure means by the distance between the image carrying body and the developing means is within a given range.

3. An image forming apparatus according to claim 2, wherein a counting value of said counting means is reset, when one of the developing agent and the image carrying body is changed.

4. An image forming apparatus according to claim 2, further comprising:

first storage means for storing data of the non-image region potential of the image carrying body corresponding to a frequency in use of the image carrying body;

second storage means for storing data of difference voltage between the non-image region potential of the image carrying body and the developing bias voltage corresponding to a frequency in use of the developing agent; and third storage means for storing data of difference voltage between the developing bias voltage and the voltage applied from said charging means to the image carrying body corresponding to a frequency in use of the developing agent.

5. An image forming apparatus according to claim 4, wherein said voltage control means controls the developing bias voltage with respect to a sum of the voltages stored in said first storage means and stored in said second storage means.

6. An image forming apparatus according to claim 4, wherein the non-image region potential has a voltage such that an image is not exposed by the exposure means on the image carrying body.

7. An image forming apparatus according to claim 5, wherein said voltage control means controls the voltage applied from said charging means to the image carrying body with respect to a sum of the voltages stored in said third storage means and the sum of the voltages stored in said first storage means and stored in said second storage means.

8. An image forming apparatus according to claim 1, wherein the non-image region potential has a voltage such that an image is not exposed by the exposure means on the image carrying body.

9. An image forming apparatus comprising:

charging means for charging an image carrying body;

exposure means for forming an electrostatic latent image on the image carrying body charged by the charging means;

developing means, having a developing roller located at a distance from the image carrying body and storing a developing agent formed of carrier members having a particle diameter of 30 to 50 μm and toner particles mixed in the carrier members so that the covering rate of the carrier members ranges from 30 to 40%, the stored developing agent being used to develop the electrostatic latent image formed by the exposure means, opposed to the image carrying body and adapted to supply the developing agent to the latent image formed by the exposure means, thereby developing the image;

developing bias voltage applying means for applying a developing bias voltage to the developing means; and voltage control means for controlling the charging by the charging means and the voltage applied by the developing bias voltage applying means so that a value obtained by dividing the difference between the developing bias voltage and a non-image region potential of the image carrying body by the distance between the image carrying body and the developing means ranges from 60 to 220 (V/mm).

10. An image forming apparatus according to claim 9, wherein the non-image region potential has a voltage such that an image is not exposed by the exposure means on the image carrying body.

11. An image forming apparatus comprising:

charging means for charging an image carrying body;

exposure means for forming an electrostatic latent image on the image carrying body charged by the charging means;

a developing roller located at a distance from the image carrying body and storing a developing agent formed of carrier members having a particle diameter of 30 to 50 μm and toner particles mixed in the carrier members so that the covering rate of the carrier members ranges from 30 to 40%, the stored developing agent being used to develop the electrostatic latent image formed by the exposure means; and bias voltage applying means for applying a developing bias voltage to the developing roller so that a value obtained by dividing the difference between the developing bias voltage and a non-image region potential of the image carrying body by the distance between the image carrying body and the developing means ranges from 60 to 220 (V/mm), wherein the diameter of the developing roller ranges from 2 $(KV)^2/12{,}000$ to 2 $(KV)^2/8{,}000$, where V (mm/s) is the image forming speed, and K is the ratio of the moving speed of the outer peripheral surface of the developing roller to the moving speed of the outer peripheral surface of the image carrying body.

12. An image forming apparatus according to claim 9, wherein a diameter of the developing roller is 2 $(KV)^2/8{,}000$, where V (mm/s) is the image forming speed, and K is the ratio of the moving speed of the outer peripheral surface of the developing roller to the moving speed of the outer peripheral surface of the image carrying body.

13. An image forming apparatus according to claim 11, wherein the non-image region potential has a voltage such that an image is not exposed by the exposure means on the image carrying body.

14. An image forming apparatus comprising:

charging means for charging an image carrying body;

exposure means for forming an electrostatic latent image on the image carrying body charged by the charging means;

a developing roller located at a distance from the image carrying body and storing a developing agent formed of carrier members having a particle diameter of 30 to 50 μm and toner particles mixed in the carrier members so that the covering rate of the carrier members ranges from 30 to 40%, the stored developing agent being used to develop the electrostatic latent image formed by the exposure means;

counting means for counting the frequency in use of the image carrying body and/or the developing agent; and bias voltage applying means for applying a developing bias voltage to the developing roller so that a value obtained by dividing the difference between the developing bias voltage and a non-image region potential of the image carrying body by the distance between the image carrying body and the developing means ranges from 60 to 200 (V/mm), wherein the diameter of the developing roller ranges from 2 $(KV)^2/12{,}000$ to 2 $(KV)^2/8{,}000$, where V (mm/s) is the image forming speed, and K is the ratio of the moving speed of the outer peripheral surface of the developing roller to the moving speed of the outer peripheral surface of the image carrying body.

15. An image forming apparatus according to claim 14, wherein a counting value of said counting means is reset, when one of the developing agent and the image carrying body is changed.

16. An image forming apparatus according to claim 14, wherein the non-image region potential has a voltage such that an image is not exposed by the exposure means on the image carrying body.

17. An image forming apparatus comprising:

charging means for charging an image carrying body;

exposure means for forming an electrostatic latent image on the image carrying body charged by the charging means;

developing means opposed to the image carrying body and adapted to supply a developing agent to the latent image formed by the exposure means, thereby developing the image;

developing bias voltage applying means for applying a developing bias voltage to the developing means; and voltage control means for controlling the charging by the charging means and the voltage applied by the developing bias voltage applying means so that a value obtained by dividing the difference between the developing bias voltage and a non-image region potential of the image carrying body by a distance between the image carrying body and the developing means ranges from 80 to 180 (V/mm).

18. An image forming apparatus according to claim 17, wherein the non-image region potential has a voltage such that an image is not exposed by the exposure means on the image carrying body.

* * * * *